United States Patent [19]

Graham, Jr.

[11] 3,945,557

[45] Mar. 23, 1976

[54] PARTITION DIVIDER

[75] Inventor: James R. Graham, Jr., Davenport, Iowa

[73] Assignee: Container Corporation of America, Chicago, Ill.

[22] Filed: Feb. 10, 1975

[21] Appl. No.: 548,191

Related U.S. Application Data

[63] Continuation-in-part of Ser. No. 354,922, April 27, 1973.

[52] U.S. Cl. ..... 229/15; 229/27

[51] Int. Cl.[2] ..... B65D 3/24

[58] Field of Search ..... 229/15, 27, 28, 42

[56] References Cited

UNITED STATES PATENTS

| | | | |
|---|---|---|---|
| 1,464,182 | 8/1923 | Levigton | 229/15 |
| 1,707,771 | 4/1929 | Richardson | 229/42 X |
| 2,314,896 | 3/1943 | Powell | 229/28 R |
| 2,329,866 | 9/1943 | Van Sickles | 229/27 |
| 2,857,089 | 10/1958 | Roche et al. | 229/28 |
| 3,352,473 | 11/1967 | Graser | 229/15 |
| 3,394,860 | 7/1968 | Griffith | 229/15 |
| 3,722,738 | 3/1973 | Wright | 206/190 |

*Primary Examiner*—Davis T. Moorhead
*Attorney, Agent, or Firm*—Carpenter, Ostis & Lindberg

[57] ABSTRACT

A partition divider is formed from a cut and scored blank of flat sheet material such as paperboard or the like and comprises a flat blank having at least one partition divider erectable from the plane of the blank. The divider is comprised of a partition member and a partition position maintaining member defined by cut lines and a common, continuous hinge line in the material of the flat blank. The partition member is rotatable out of the plane of the blank along the hinge line through an angle of 90% approximately to an erected position, and the partition position maintaining member is rotatable independently of the partition member in the same direction out of the plane of the blank along the common hinge line through an angle of approximately 180° and into an opening resulting from the rotation of the partition member thereby maintaining the erected position of the partition member.

1 Claim, 3 Drawing Figures

PARTITION DIVIDER

This application is a continuation-in-part of my copending patent application, Ser. No. 354,922, filed Apr. 27, 1973.

BACKGROUND OF THE INVENTION

1. Field of the Invention

The invention herein relates generally to that class of structures employed in the packaging of discrete articles of merchandise to maintain them in a separated state.

2. The Prior Art

The prior art is best exemplified in the following patents:

| | | | |
|---|---|---|---|
| Levigton | 1,464,182 | Aug. 7,1923 | 229/15 |
| Powell | 2,314,896 | March 30, 1943 | 229/28 |
| Van Sickels | 2,329,866 | Sept. 21, 1943 | 229/27 |
| Roche | 2,857,089 | Oct. 21, 1958 | 229/28 |
| Graser | 3,352,473 | Nov. 14,1967 | 229/15 |
| Griffith | 3,394,860 | July 30, 1968 | 229/15 |

The patents listed foregoing are characterized in that a partition or separating member is folded out of the plane of the board material in which it is formed, but none of the structures shown in said patents teaches the provision of structure maintaining the partition member in the erected position.

The structure disclosed herein, on the other hand, teaches the folding of a partition member out of the plane of the board material, the partition member being maintained in position by a second member foldable out of the plane of the board material in the same direction and back into the plane of board and through an angle of approximately 180°.

THE DRAWING

Figure 1:
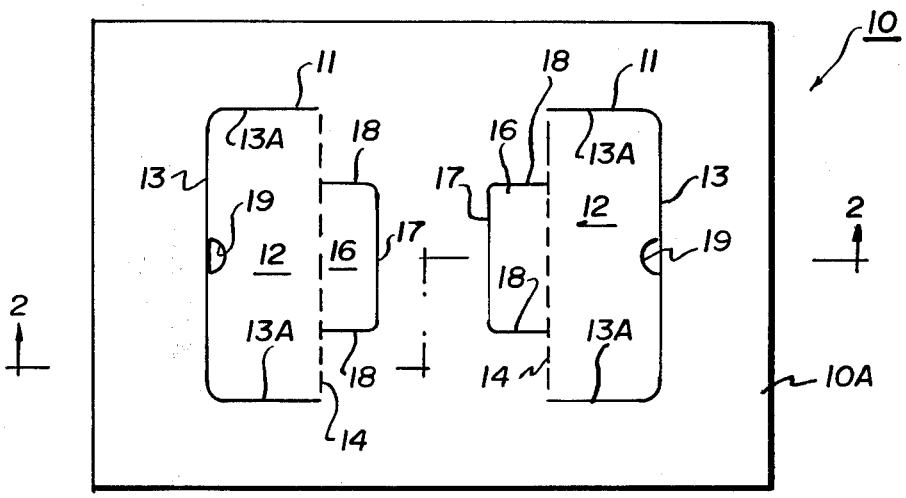
FIG. 1 is a plan view of a cut and scored blank for forming a partition divider incorporating the teachings according to the present invention.

The improved partition divider according to the present invention is referred to generally by the reference numeral 10 and is formed from a cut and scored blank 10A of paperboard or the like. The latter has at least one partition divider indicated by the reference numeral 11 formed therein, and each such partition divider 11 comprises a partition member 12 defined by a first cut line 13, laterally spaced second cut lines 13A extending normally to said first cut line, and by a continuous hinge line 14.

A partition position maintaining member indicated generally by the reference numeral 16 is partly defined by a first cut line 17 spaced from and parallel to the continuous hinge line 14 and the cut line 13. The partition position maintaining members are each also defined by laterally spaced second cut lines 18 extending normally to first cut line 17 and terminating at the hinge line 14. The hinge line 14 is common to members 12 and 16 and extends continuously between second cut lines 13A of each partition member.

Figure 2:
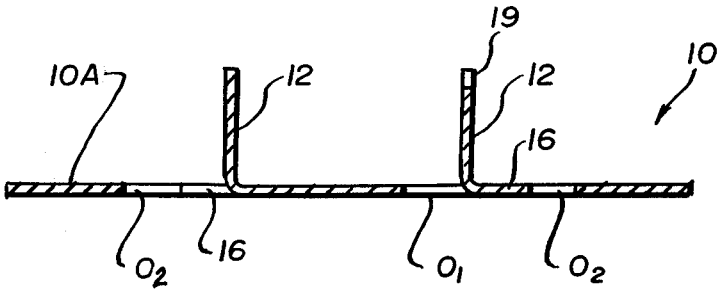
FIG. 2 is a sectional view taken along the line 2—2 of FIG. 1 looking in the direction of the arrows.

Partition member 12 is rotatable out of the plane of the blank 10A along the hinge line 14 through an angle of approximately 90° to an erected position. The partition position maintaining member 16 is rotatable in the same direction through an angle of approximately 180° leaving behind an opening $O_1$ in the blank 10A and moving into an opening $O_2$ remaining in the blank 10A resulting from the movement of the partition member 12 to the erected position seen in FIG. 2.

Each of the partition members 12 has a semicircular opening 19 in the distal edge thereof whereby the member 12 may be rotated out of the plane of the blank 10A.

The partition divider 10 is shown in position in a conventional shipping container C, the erected partition members 12 serving to separate canned articles referred to by reference character CH. By reason of the elasticity of the material of the blank 10A and by reason of the rotation of the members 12 and 16 through the angles recited, each partition member can assume and maintain the erected position.

Figure 3:
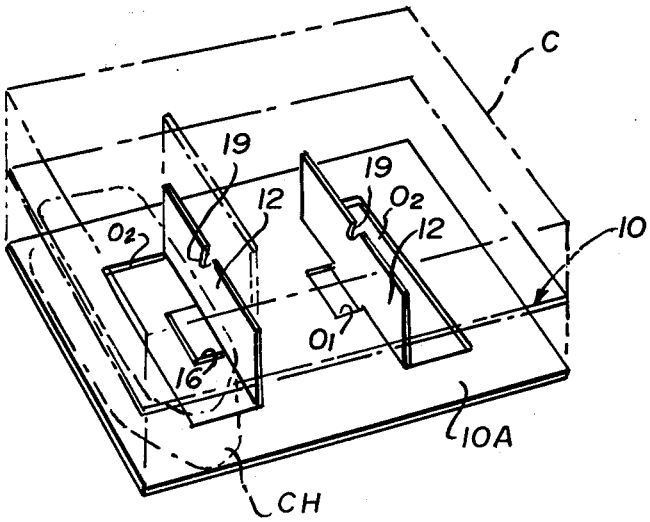
FIG. 3 is an isometric view showing the divider according to the present invention in situ within a conventional shipping container.

As seen in FIG. 3 the partition dividers 10 can be tiered, each divider maintaining separation between tiers of the articles CH within the container C.

The continuous hinge line 14 separates members 12 and 16 so that they can be rotated about the hinge line 14 independently of one another. The essence of the concept disclosed in this application deals with deliberate folding of member 16 through 180° while member 12 is rotated only 90° so that the tension generated by that part of the hinge line across member 16 operates in a reverse direction from the tension on the remainder of the hinge line 14. The two tension forces tend to neutralize one another so that member 12 remains in the 90° position instead of returning to its original plane.

I claim:

1. A partition divider formed from a cut and scored blank of flat sheet material such as paperboard or the like comprising:

a. a flat blank;

b. at least one partition divider erectable from the plane of said blank comprised of:

c. a partition member and a partition position maintaining member defined by first cut lines and laterally spaced second cut lines normal to said first cut lines;

d. said partition member and said partition position maintaining member being further defined by a common hinge line formed in the material of the blank and extending continuously between said laterally spaced second cut lines;

e. said partition member being rotatable independently of said partition position maintaining member about said common hinge line out of the plane of said blank through an angle of approximately 90° to an erected position;

f. said partition position maintaining member being rotatable independently of said partition member about said common hinge line in the same direction through an angle of approximately 180° and into the opening resulting from the rotation of said partition member to maintain the erected position of said partition member.

* * * * *